US005092070A

United States Patent [19]

Perkins

[11] Patent Number: 5,092,070

[45] Date of Patent: Mar. 3, 1992

[54] PISTOL SUPPORT STOCK

[76] Inventor: Vernon R. Perkins, 8914 E. 33rd Pl., Tulsa, Okla. 74145

[21] Appl. No.: 619,591

[22] Filed: Nov. 29, 1990

[51] Int. Cl.[5] ..... F41C 23/12

[52] U.S. Cl. ..... 42/71.02

[58] Field of Search ..... 42/71.02, 94, 72

[56] References Cited

U.S. PATENT DOCUMENTS

| | | | |
|---|---|---|---|
| 815,609 | 3/1906 | Martin | 42/72 |
| 1,016,695 | 2/1912 | Kimmel | 42/72 |
| 1,266,633 | 3/1918 | Sachs | 42/72 |
| 1,557,865 | 10/1925 | Neel et al. | 42/72 |
| 1,877,016 | 9/1932 | Munson | 42/72 |
| 3,609,902 | 10/1971 | Casull | 42/72 |
| 3,685,194 | 8/1972 | Coon | 42/72 |
| 4,271,623 | 6/1981 | Beretta | 42/72 |

*Primary Examiner*—Michael J. Carone
*Attorney, Agent, or Firm*—Leon Gilden

[57] ABSTRACT

A support stock is provided in combination with an electronic pistol as utilized in electronic gaming devices, wherein the support stock includes an elongate stock member, with an arcuate rear wall and a forward "L" shaped leg extending downwardly and generally orthogonally relative to an axis defined by the stock member. The "L" shaped leg includes a notch to receive a lowermost edge of a pistol grip back strap formed on the pistol grip of the electronic pistol, with parallel spaced legs mounted to an upper end of the stock member extending forwardly thereof to receive the receiver frame of the pistol therebetween. A modification of the invention includes a plurality of support legs, including suction cups at each end thereof for securement of the stock in a desired orientation. A further modification includes a support plate mounting a support shaft pivotally mounted to the support plate and threadedly received within the support stock adjacent an arcuate rear wall of the support stock.

4 Claims, 4 Drawing Sheets

PISTOL SUPPORT STOCK

BACKGROUND OF THE INVENTION

1. Field of the Invention

The field of invention relates to stock extensions for pistols, and more particularly pertains to a new and improved pistol support stock wherein the same is arranged for mounting to an associated pistol grip of an associated electronic pistol for providing enhanced securement and alignment of the pistol in a sighting procedure during use.

2. Description of the Prior Art

Various pistol grip extensions have been utilized in the prior art to provide elongate support to a pistol grip to enhance the support and steadiness of the pistol in use. Such apparatus may be found in U.S. Pat. No. 1,877,016 to Munson wherein an elongate member is threadedly mounted to a rear portion of the pistol.

U.S. Pat. No. 1,557,865 to Neel provides for a holster with a loop mounted at a lower terminal end thereof, wherein the loop receives a lower terminal end of a pistol to provide support of the pistol in use.

U.S. Pat. No. 3,685,194 to Coon sets forth a stock member to receive the frame and pistol grip portion of a pistol therewithin in converting the pistol to a rifle further utilizing an elongate barrel mounted to the pistol for such purpose.

U.S. Pat. No. 4,271,623 to Berretta sets forth an extensible pistol grip hingedly mounted about its center and fixedly mounted to a lower terminal end of an associated pistol grip stock.

U.S. Pat. No. 2,433,151 to parsons sets forth a further example of a stock extension for a pistol that is pivotally mounted to a lower terminal end of the pistol and more specifically the magazine to provide enhanced securement and alignment of a pistol in use.

As such, it may be appreciated that there continues to be a need for a new and improved pistol support stock as set forth by the instant invention which addresses both the problems of ease of use as well as effectiveness in use with electronic gaming pistols, wherein such pistols are readily and slidably mounted within the extension stock arrangement negating use for associated fasteners and the like.

SUMMARY OF THE INVENTION

In view of the foregoing disadvantages inherent in the known types of pistol support extension stocks now present in the prior art, the present invention provides a pistol support stock wherein the same slidably receives a pistol within an elongate stock for providing a steady rest and support to the pistol in use. As such, the general purpose of the present invention, which will be described subsequently in greater detail, is to provide a new and improved pistol support stock which has all the advantages of the prior art pistol stock extension apparatus and none of the disadvantages.

To attain this, the present invention provides a support stock in combination with an electronic pistol as utilized in electronic gaming devices, wherein the support stock includes an elongate stock member, with an arcuate rear wall and a forward "L" shaped leg extending downwardly and generally orthogonally relative to a axis defined by the stock member. The "L" shaped leg includes a notch to receive a lowermost edge of a pistol grip back strap formed on the pistol grip of the electronic pistol, with parallel spaced legs mounted to an upper end of the stock member extending forwardly thereof to receive the receiver frame of the pistol therebetween. A modification of the invention includes a plurality of support legs, including suction cups at each end thereof for securement of the stock in a desired orientation. A further modification includes a support plate mounting a support shaft pivotally mounted to the support plate and threadedly received within the support stock adjacent an arcuate rear wall of the support stock.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pistol support stock which has all the advantages of the prior art pistol stock extension apparatus and none of the disadvantages.

It is another object of the present invention to provide a new and improved pistol support stock which may be easily and efficiently manufactured and marketed.

It is a further object of the present invention to provide a new and improved pistol support stock which is of a durable and reliable construction.

An even further object of the present invention is to provide a new and improved pistol support stock which is susceptible of a low cost of manufacture with regard to both materials and labor, and which accordingly is then susceptible of low prices of sale to the consuming public, thereby making such pistol support stocks economically available to the buying public.

Still yet another object of the present invention is to provide a new and improved pistol support stock which provides in the apparatuses and methods of the prior art some of the advantages thereof, while simultaneously overcoming some of the disadvantages normally associated therewith.

Still another object of the present invention is to provide a new and improved pistol support stock wherein the same utilizes a mounting flange underlying spaced legs to slidably receive a pistol stock therewithin to provide alignment for the pistol in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
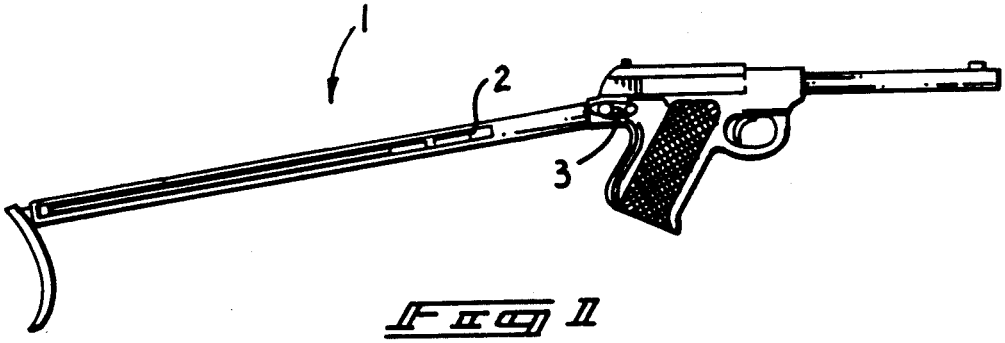
FIG 1 PRIOR ART
FIG. 1 is an orthographic side view, taken in elevation, of a prior art pistol support stock.

With reference now to the drawings, and in particular to FIGS. 1 to 8 thereof, a new and improved pistol support stock embodying the principles and concepts of the present invention and generally designated by the reference numeral 10 will be described.

Figure 2:
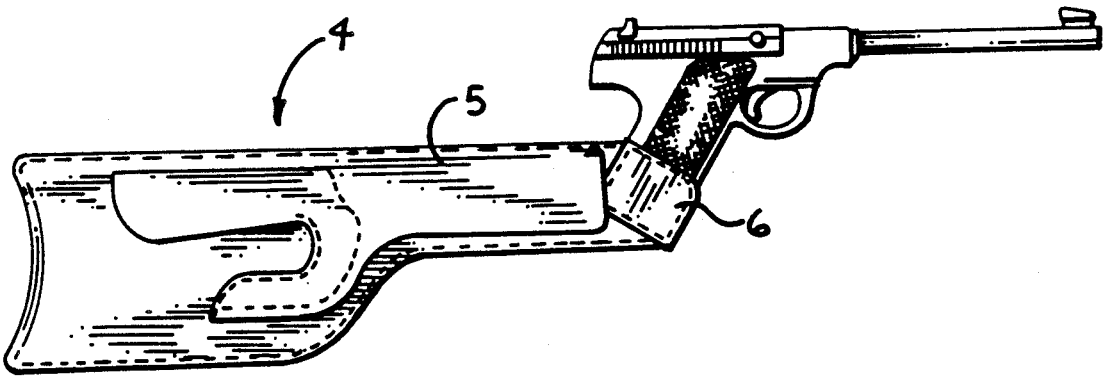
FIG 2 PRIOR ART
FIG. 2 is an orthographic side view, taken in elevation, of a further example of a pistol support stock and holster assembly.
Figure 3:
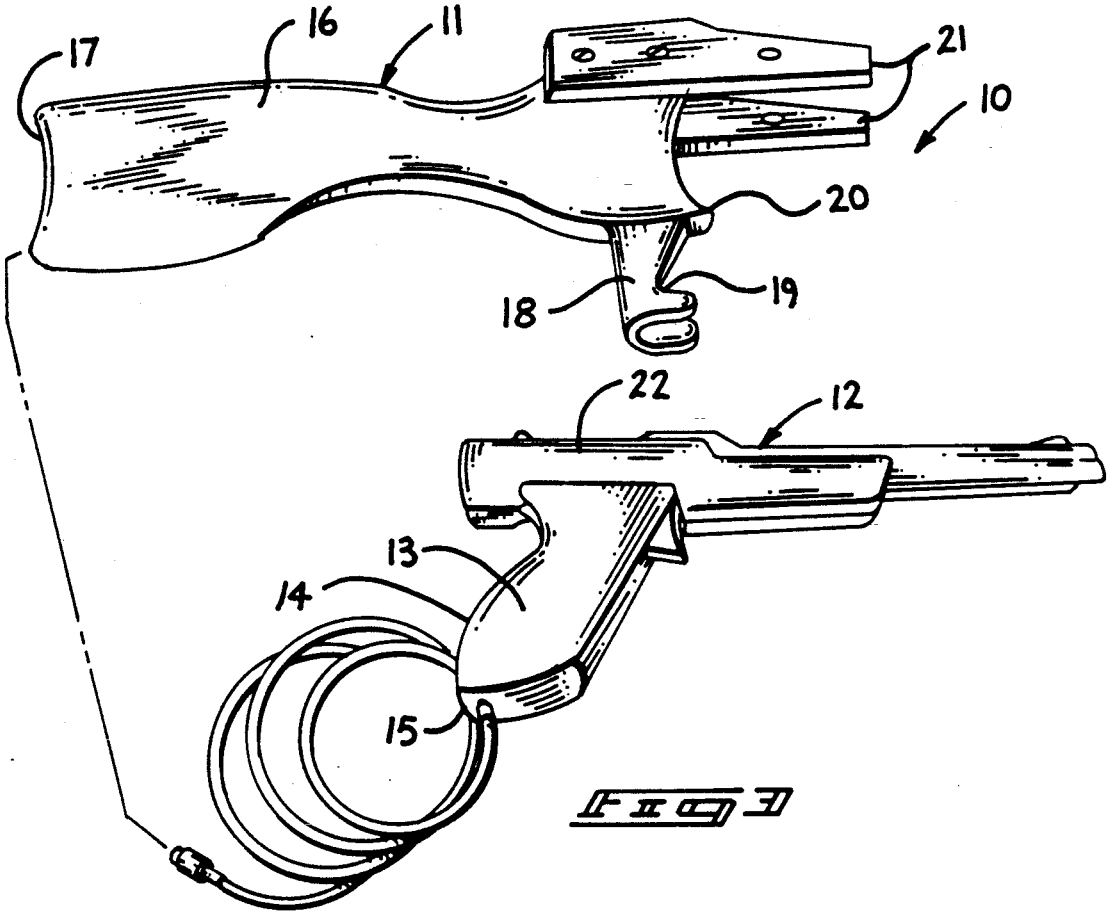
FIG. 3 is an isometric illustration of the instant invention.
Figure 4:
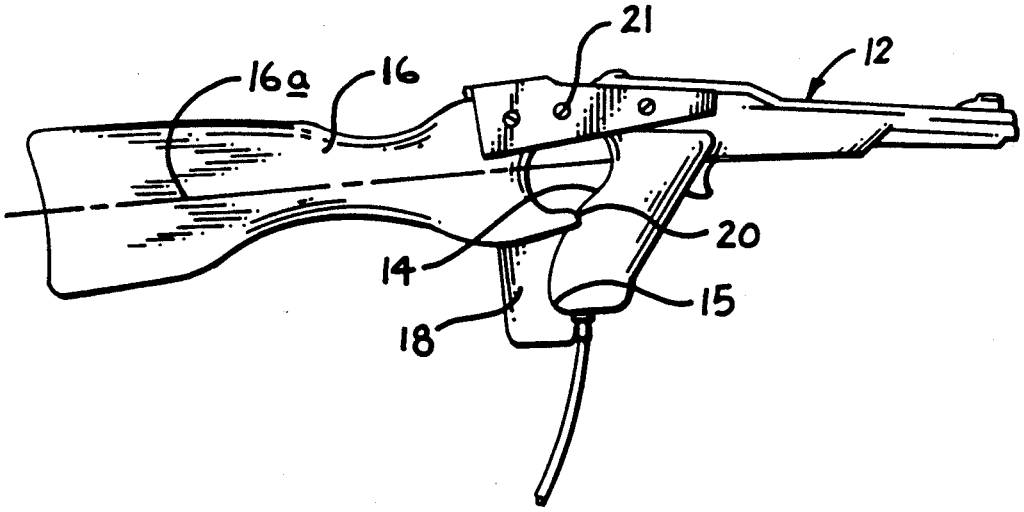
FIG. 4 is an orthographic side view, taken in elevation, of the instant invention.

FIG. 1 illustrates a prior art pistol grip extension stock 1, wherein the stock includes a telescoping member 2 that is fixedly mounted utilizing a fastener assembly 3 to a rear portion of an associated pistol, as set forth in U.S. Pat. No. 1,877,016. FIG. 2 illustrates a further prior art pistol stock extension arrangement 4, wherein a holster 5 includes a sleeve 6 at a lower terminal end thereof to receive a lower terminal end of a pistol member therewithin, in a manner as set forth in U.S. Pat. No. 1,557,865.

More specifically, the pistol support stock 10 of the instant invention essentially comprises a support stock 11 mounting an electronic pistol 12 therewithin. The pistol 12 includes a pistol grip 13 extending downwardly from an associatably received frame 22 of the pistol 12 The pistol grip 13 includes an arcuate pistol grip back strap 14 terminating at a lower back strap edge 15. The support stock 11 includes a rigid, elongate stock member 16 defined along a longitudinal axis **16*a* (see FIG. 4). The stock member 16 includes an arcuate rear wall 17 formed to a rear terminal end of the stock member, with a downwardly extending "L" shaped leg 18 mounted generally orthogonally to the axis 16*a* at a forward terminal end of the stock member 16. The "L" shaped leg 18 defines an edge receiving notch 19 to receive the lower back of edge 15 when mounted within the leg 18, with a vertical interior surface of the "L" shaped leg complementarily receiving the arcuate pistol grip back strap 14 therewithin. A positioning tang 20 extends torwardly of a forward lower terminal end of the stock 16 and extends beyond the "L" shaped leg in abutment with the back strap 14 to position the back strap within the support stock 11. Parallel spaced legs 21 are mounted to an upper forward terminal end of the stock member 16 and are spaced apart a predetermined width substantially equal to the predetermined width defined by the receiver frame 22 to position the electronic pistol within the support stock 11**.

Figure 5:
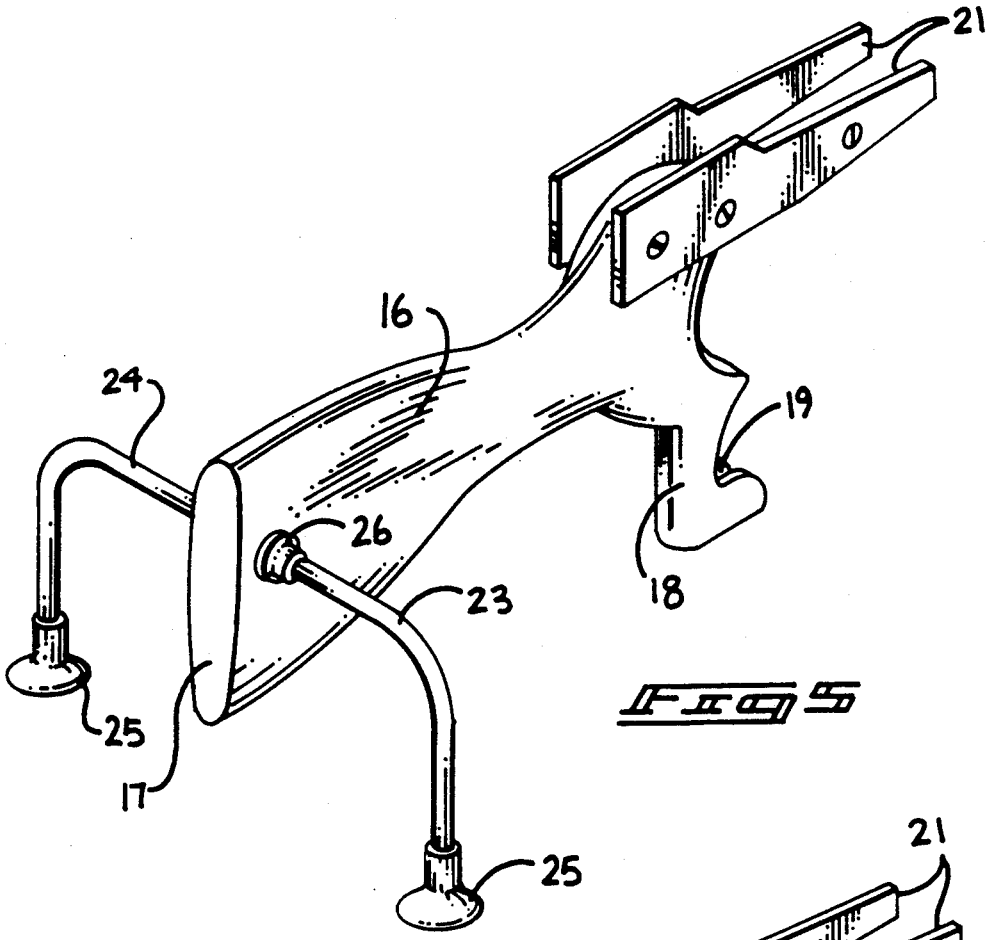
FIG. 5 is an isometric illustration of a modification of the instant invention.

FIG. 5 illustrates a modified pistol support stock member, including a right and left "L" shaped support leg 23 and 24 mounting a lower suction cup 25 at each lower terminal end of each support leg and mounting an upper suction cup 26 at each upper end of each support leg to permit securement of the stock between the upper suction cups 26 and positioning of the lower suction cups 25 upon a support surface to enhance alignment and positioning of the stock member 16.

Figure 6:
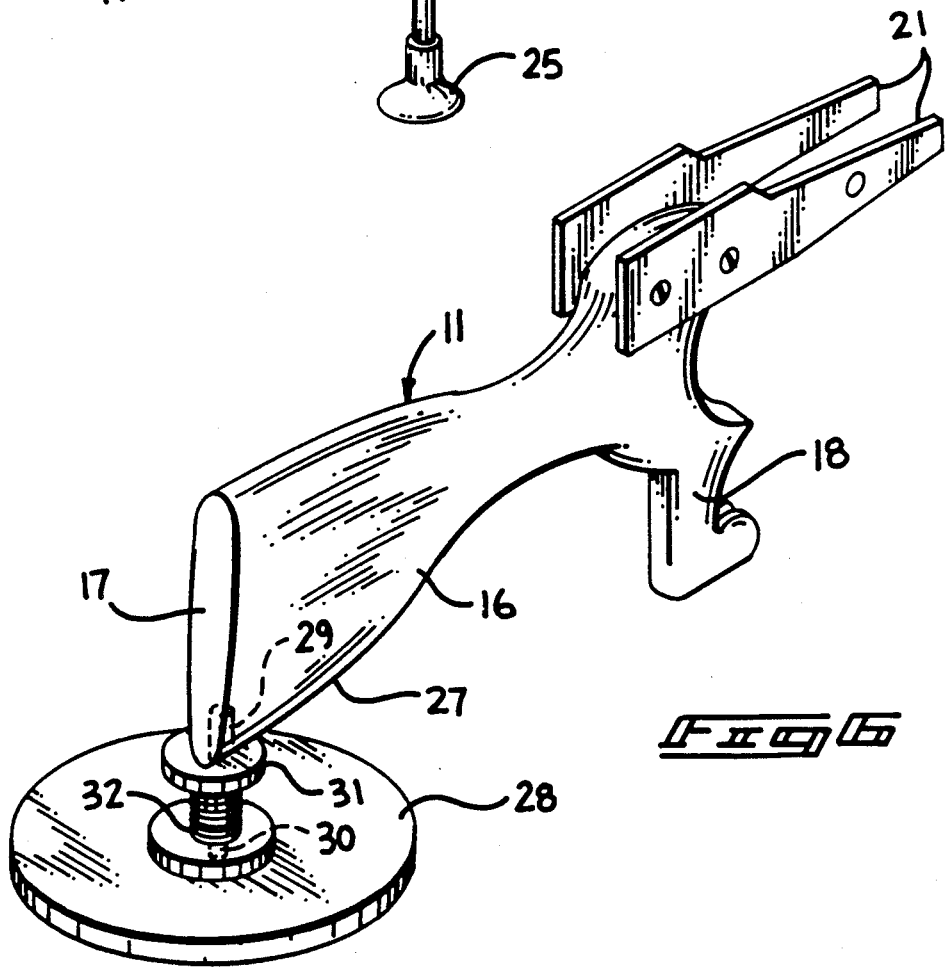
FIG. 6 is an isometric illustration of a further modification of the instant invention.
Figure 7:
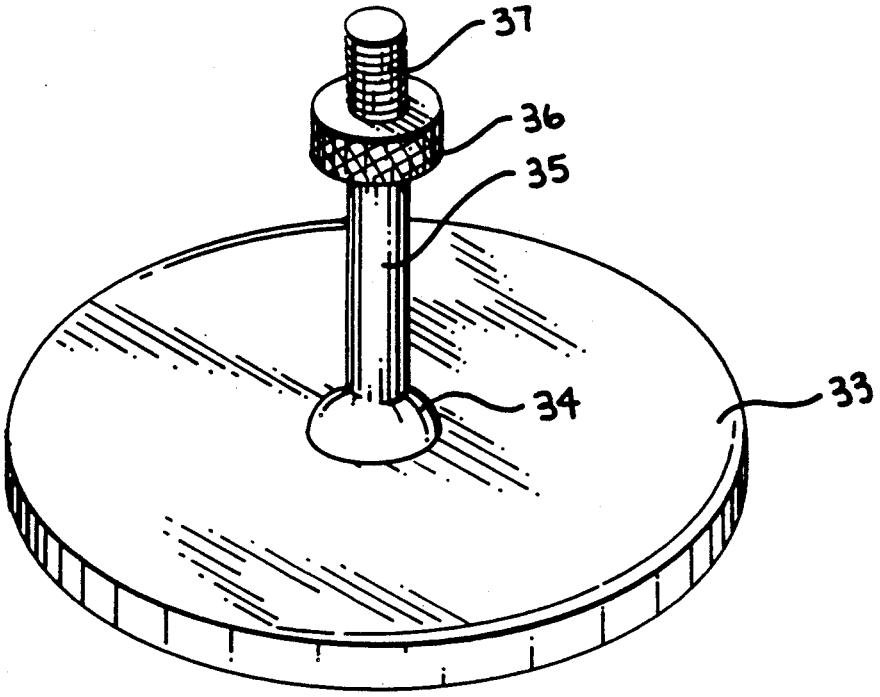
FIG. 7 is an isometric illustration of the support mount utilized by the instant invention.

FIG. 6 illustrates the use of the stock member 16, including an internally threaded bore 29 and to complementarily receive an externally threaded mounting rod 37 (see FIG. 7 for example). The mounting rod 37 is mounted to a thumb wheel 31 that in turn is mounted to a support shaft 32 A pivot pin 30 extends into an associated support plate 28 for mounting of the stock member 16.

FIG. 7 illustrates a modified organization, wherein the use of a modified support plate 33 includes a swivel connection 34 coaxially thereof, with the swivel connection 34 receiving a mounting rod 35 in a swivel type association, With the thumb wheel 36 including the externally threaded rod 37 coaxially aligned with the mounting rod 35.

Figure 8:
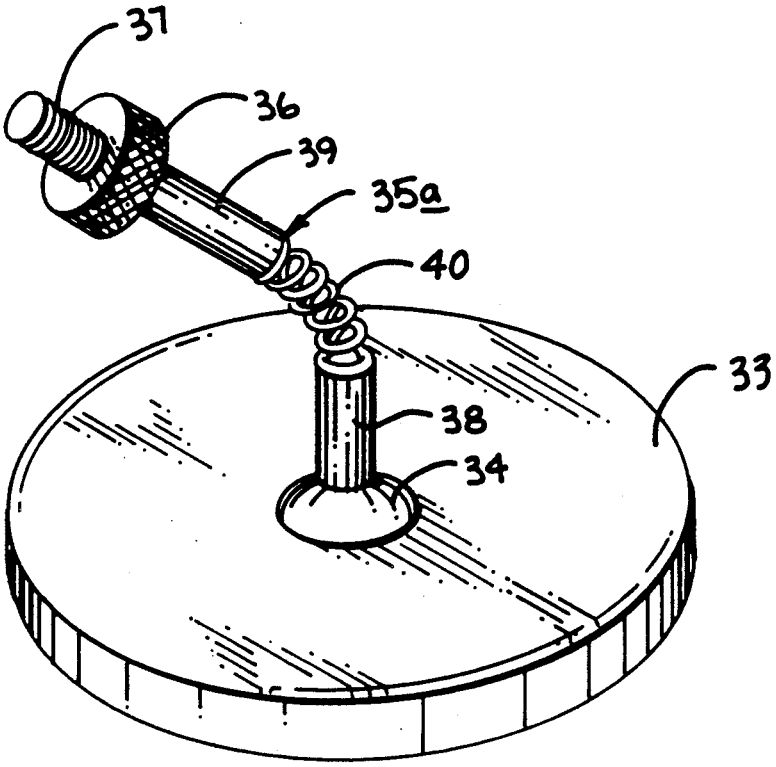
FIG. 8 is an isometric illustration of a further modified support mount utilized by the instant invention.

FIG. 8 illustrates a further modified organization, wherein the modified support plate 33 includes a modified mounting rod **35*a*. The modified mounting rod 35*a* includes a lower rod member 38 in swivel association with the modified support plate 33 through the swivel connection 34 secured to an upper rod member 39 through a stiff coil spring 40 to allow tilted movement of the externally threaded rod mounting 37 when secured within the internally threaded bore 29**.

As to the manner of usage and operation of the instant invention, the same should be apparent from the above disclosure, and accordingly no further discussion relative to the manner of usage and operation of the instant invention shall be provided With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope to the invention.

What is claimed as being new and desired to be protected by LETTERS PATENT of the United States is as follows:

1. A pistol support stock apparatus comprising, in combination, a pistol member, the pistol member including a pistol grip directed downwardly from a receiver frame, the receiver frame defined by a predetermined width, the pistol grip including an arcuate pistol grip back strap terminating in a lower back strap edge, and a rigid, elongate stock member, the stock member including a rear terminal end and forward terminal end, the stock memmber further including a longitudinal axis, and support means mounted to the forward terminal end for frictionally receiving the pistol, and wherein the support means includes an "L" shaped leg, the "L" shaped leg is fixedly and orthogonally mounted to the forward terminal end of the elongate stock member in an orthogonal relationship relative to the longitudinal axis, and the "L" shaped leg including an edge receiving notch for receiving the lower back strap edge, and a vertical leg of the "L" shaped leg complimentarily receiving the arcuate pistol grip back strap therewith, and including a positioning tang mounted axially to the stock member at a lower terminal edge of the forward terminal end extending axially beyond the "L" shaped leg for engagement with an upper portion of the arcuate pistol grip back strap above the "L" shaped leg.

2. An apparatus as set forth in claim 1 further including a plurality of parallel spaced legs spaced apart the predetermined width, wherein the parallel spaced legs are fixedly mounted to the forward terminal end of the stock member at an upper portion thereof frictionally receiving the receiver frame therebetween.

3. An apparatus as set forth in claim 2 wherein the stock member includes an internally threaded bore directed through a bottom surface of the stock member adjacent the rear terminal end, and a support plate, the support plate including a swivel connection axially of the support plate, and the swivel connection including a mounting rod mounted within the swivel connection to effect a swivel association to the mounting rod and the support plate, and the mounting rod including a thumb wheel orthogonally mounted to an upper terminal end of the mounting rod, and an externally threaded mounting rod coaxially mounted to the thumb wheel above the mounting rod, and the externally threaded mounting rod complementarily received with the internally threaded bore.

4. An apparatus as set forth in claim 3 wherein the mounting rod includes a lower rod member mounted to the swivel connection, and an upper rod member mounted to the thumb wheel, and a coil spring coaxially arranged between the lower rod member and the upper rod member to permit tilting of the upper rod member relative to the lower rod member.

* * * * *